US005318057A

United States Patent [19]

Wallum

[11] Patent Number: 5,318,057

[45] Date of Patent: Jun. 7, 1994

[54] HALF-STEP STABILITY CANE

[76] Inventor: Ronald I. Wallum, P.O. Box 5282, Fargo, N. Dak. 58105

[21] Appl. No.: 897,488

[22] Filed: Jun. 12, 1992

[51] Int. Cl.[5] ..... A45B 7/00

[52] U.S. Cl. ..... 135/65; 135/77

[58] Field of Search ..... 135/65, 66, 77, 75, 135/81, 70

[56] References Cited

U.S. PATENT DOCUMENTS

| | | | |
|---|---|---|---|
| D. 150,031 | 6/1948 | Richards . | |
| D. 287,283 | 12/1986 | Johnson . | |
| 567,985 | 8/1896 | LeClair . | |
| 2,044,260 | 6/1936 | Schiele . | |
| 2,642,074 | 6/1953 | Pedley et al. . | |
| 2,730,412 | 1/1956 | Yoder . | |
| 2,782,796 | 2/1957 | Blue . | |
| 3,207,260 | 9/1965 | Castagna . | |
| 3,273,575 | 9/1966 | Aldrich . | |
| 3,289,685 | 12/1966 | Parker | 135/65 |
| 3,381,775 | 5/1968 | Livers . | |
| 3,578,110 | 5/1971 | Seagraves . | |
| 3,738,674 | 6/1973 | Pauls . | |
| 3,826,336 | 7/1974 | Cramer . | |
| 3,841,437 | 10/1974 | Caughey . | |
| 3,884,327 | 5/1975 | Zigman . | |
| 3,906,971 | 9/1975 | Burnstine . | |
| 4,113,161 | 9/1978 | Manuszak . | |
| 4,250,977 | 2/1981 | Deli . | |
| 4,258,735 | 3/1981 | Meade . | |
| 4,274,430 | 6/1981 | Schaaf et al. | 135/65 |
| 4,378,862 | 4/1983 | Carmel . | |
| 4,844,199 | 7/1989 | Nimz . | |

*Primary Examiner*—Carl D. Friedman
*Assistant Examiner*—Lan C. Mai
*Attorney, Agent, or Firm*—Schroeder & Siegfried

[57] ABSTRACT

A combined stability cane and device for assisting a handicapped person in traveling up and down a flight of stairs having vertically spaced steps is disclosed. A rectangular block member or platform has a flat upper surface within which a connector mechanism is provided at its central area, and a second connector mechanism is provided in the upper surface adjacent one of the sides of the block member and opposite the central area. A walking cane having a cooperative connector mechanism adjacent its lower end is provided to alternatively rigidly connect the same to one of the two connector mechanisms in the upper surface of the block member. When the cane is connected to the connector mechanism at the central area of block member, the combination functions as an excellent stability cane. When the cane is connected to the connector mechanism adjacent one side of the block member, the latter functions as a half-step which the handicapped person may utilize to facilitate travel up and down the steps by taking only a half-step at a time, at first on the block member and then upon the next step, thereby reducing the elevation change required through a series of half-steps. Alternatively, the walking cane may be disconnected from the block member so as to use the same in its normal manner.

24 Claims, 3 Drawing Sheets 70
10
16
64
60
66
68
69
62
38
32
30
36
38
18
12
24
26
36
34
20
14
28
22

HALF-STEP STABILITY CANE

BACKGROUND OF THE INVENTION

Various devices have been designed in the past to facilitate the travel by a handicapped person up and down a flight of stairs. None of these, to the best of my knowledge, has proved sufficiently satisfactory to enable the designer to continue to furnish them upon the market. Some of them, such as the one shown in U.S. Pat. No. 4,844,199, issued to Nimz on Jul. 4, 1989, requires the user to move at right angles to the flight of stairs, with the net result that the handicapped person is required to repeatedly move backwardly or turn about, which is a dangerous requirement for a handicapped person because they generally do not have very good balance. Moving upwardly causes the user to repeatedly move toward one of the walls defining the staircase, so that the user soon is confronted with that wall and is required to move rearwardly toward the opposite wall, or completely turn oneself about.

Others, such as that shown in U.S. Design Pat. No. 287,283, issued to Johnson on Dec. 16, 1986, requires a plurality of half-step devices, one for each step, as shown therein.

Another device, such as is shown in U.S. Pat. No. 4,258,735, issued to Meade on Mar. 31, 1981, shows a step pivotally mounted on the lower end of a cane, with the stairs having vertically spaced steps, without the assistance of others. The device includes a platform or block member having flat parallel upper and lower surfaces and vertical dimensions of approximately four (4) inches, which is about half the vertical dimensions of the risers of most steps in a flight of stairs. A pair of connector mechanisms, comprising keyed openings in the upper surface of the block member, are provided. One such connector mechanism is disposed at the central area of the upper surface of the block member, and the other adjacent one side of the block member.

A walking cane having a cooperative connector mechanism adjacent its lower end is also provided. When the cane is connected to the block member adjacent its side, the device enables a handicapped person to travel up and down the steps, without any assistance, by using the platform as a half-step and carrying it with him from step to step, moving up or down, as the case may be, as each step is completed. The device provides high stability and minimizes the vertical distance the handicapped person must move his body in each movement.

When the walking cane is connected to the central area of the block member, the handicapped person enjoys a highly stable stability cane in that the broad-based under-surface of the block member bears evenly upon the supporting surface therefor. The rectangular undersurface of the block member is continuous, rather than having bearing surfaces at three (3) or four (4) isolated locations, and thus it is much more stable.

Rigidly mounted within the block member immediately below its upper surface is a plastic socket member having a pair of rigid sockets therein for stabilizing the connection between the block member and lower end of the cane protruding when used as a walking stick, with all the dangers of slipping normally attendant to the use of a cane, which has a relatively small tip and is prone to slipping upon individual slippery spots on the floor or sidewalk. To overcome such disadvantages, others have designed so-called "stability canes" most, if not all of which, are characterized by three (3) or four (4) prongs which help to minimize the dangers of slipping in that more points of contact with the supporting surface are provided Even then, however, they do occasionally slip or, more often, one or more of the supporting prongs, which extend downwardly, is unsupported when the supporting surface is uneven, and the required support for the user is thus no longer provided.

Still another, such as that shown in U.S. Pat. No. 2,882,796, issued to Blue on Oct. 29, 1954, provides a device for aiding a handicapped person up and down a flight of stairs, but is ineffective as a walking cane or stability cane because the vertical handle is fixedly attached to the side of the half-step, making the device too cumbersome and awkward for such purposes.

It is apparent from the above that a distinct need is present for a versatile aid for the handicapped which will provide assistance in climbing a stairway, and which can be readily and easily transformed into a walking cane or, alternatively, a broad-based stability cane.

BRIEF SUMMARY OF THE INVENTION

With the above objective in mind, I have designed a combined stability cane and device for assisting a handicapped person in traveling up and down a flight of the cane. One socket is located at the center of the block member immediately below the central connecting mechanism, and the other is located immediately below the connecting mechanism which is adjacent one side thereof. Upon connecting the cane to the block member, the lower terminal portion of the cane is received within the desired socket, thereby providing stability thereto.

The walking cane connector mechanism is a spring-loaded quick-release latch which is readily releasable from the block member by simply pressing down and rotating the cane relative to the block member. There is no need for the handicapped person to bend over when disconnecting the cane from the block, which is advantageous since such movement is usually difficult for a handicapped person. The quick-release latch can be easily operated while standing and grasping the upper handle of the cane.

BRIEF DESCRIPTION OF THE DRAWINGS

These and other objects and advantages of the invention will more fully appear from the following description, made in connection with the accompanying drawings, wherein like reference characters refer to the same or similar parts throughout the several views, and in which.

DETAILED DESCRIPTION OF THE INVENTION

Figure 1:
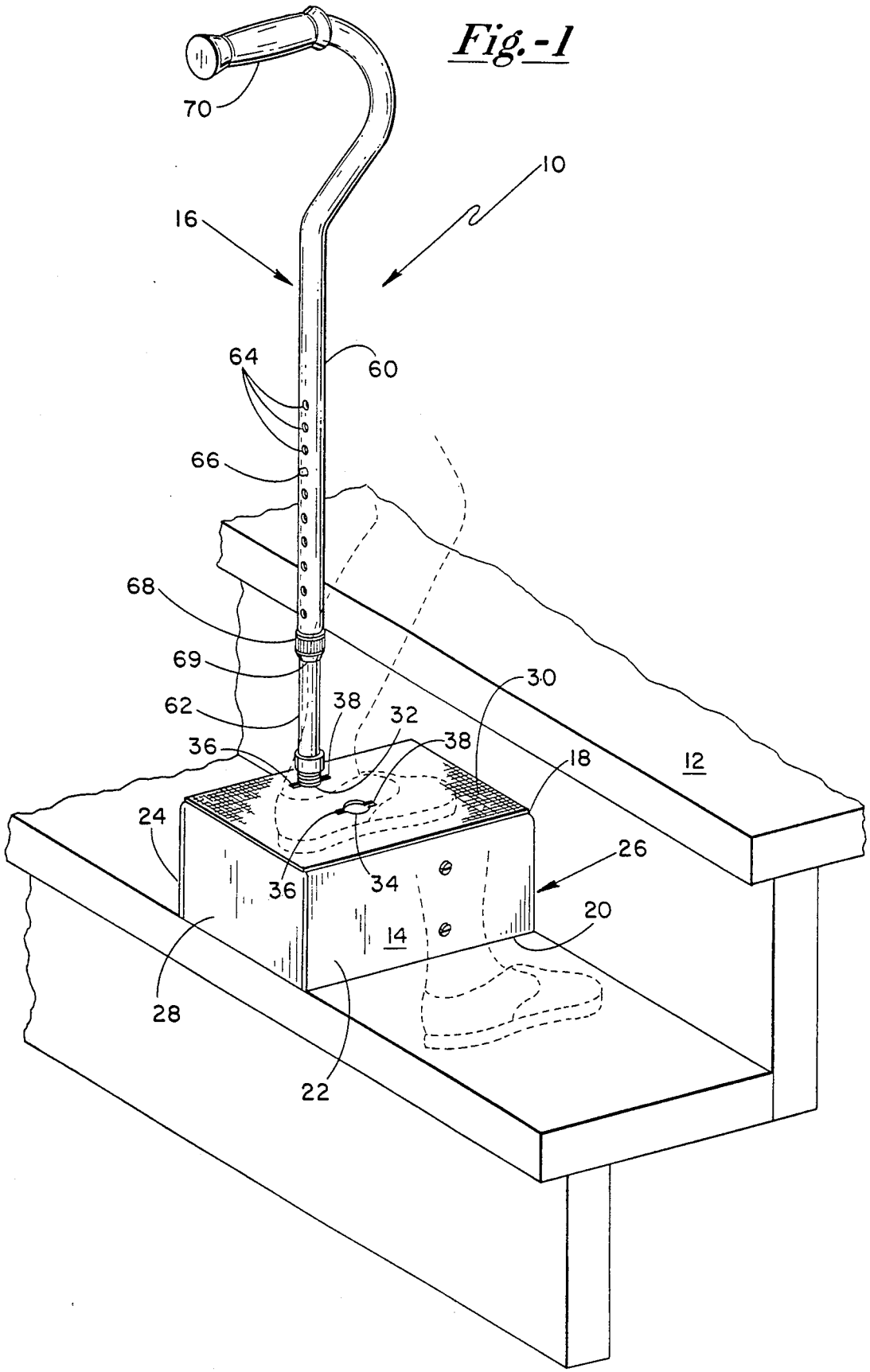
FIG. 1 is a perspective view of my half-step stability cane, showing its use as a half-step device for aiding a handicapped individual in climbing a flight of stairs.

Shown in FIG. 1 is my new half-step stability cane 10 which may be used by a handicapped individual (shown in phantom) while climbing a stairway 12, or alternatively, used as a stability cane (shown in FIG. 3) for aiding a handicapped individual while walking. My new half-step stability cane generally includes a lower platform or block member 14 into which walking cane 16 lockably engages in a readily releasable keyed relationship. The lower block member 14 has upper and lower flat parallel horizontal surfaces 18 and 20, respectively. Interconnecting the upper and lower surfaces of block member 14 are vertically disposed side portions 22 and 24, and vertically disposed front and rear ends 26 and 28. Such vertically disposed portions are approximately one-half (½) the height of a normal step riser, which is approximately eight inches (20.48 cm) high. Thus, side portions 22 and 24, and end portions 26 and 28, are generally about four inches (10.24 cm) in height.

An elastomeric friction pad 30 overlays and covers the upper surface 18 of lower block member 14, and provides a secure tread surface upon which the handicapped individual may place their foot when using the device 10 as a half-step for climbing a stairway 12. Disposed in the upper surface of the lower block member 14 are a pair of connector mechanisms, comprising keyed openings 32 and 34, which extend through friction pad 30 and upper surface 18. Each keyed opening 32 and 34 are generally circular in shape, with a pair of oppositely extending slots 36 and 38 extending outwardly therefrom. Such keyed openings are adapted to receive therewithin walking cane 16 in readily releasable keyed locking relation.

Figure 2:
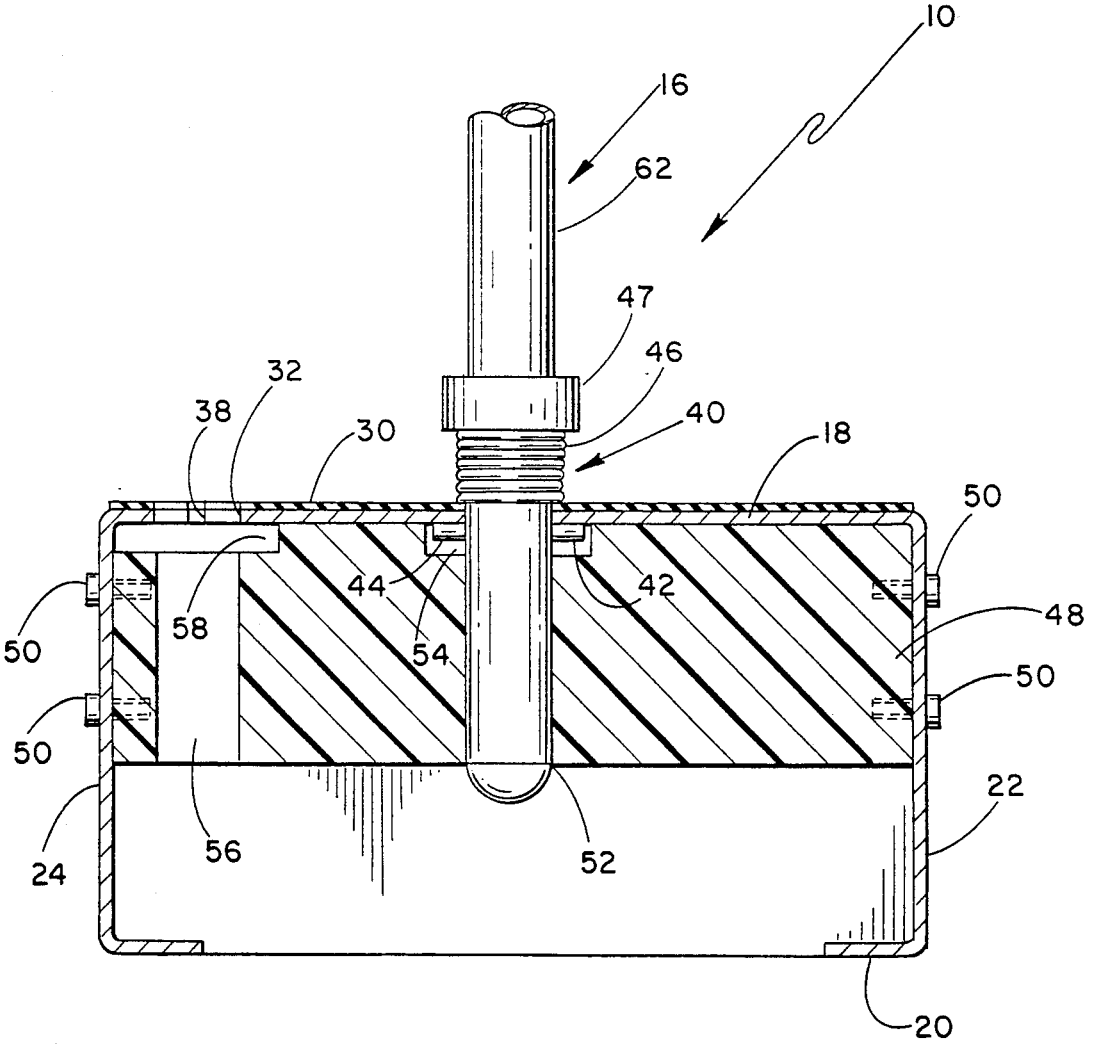
FIG. 2 is a vertical sectional view of the lower block member of my half-step stability cane, showing the keyed locking relationship between the walking cane and lower block member, and showing the socket member within which the walking cane is inserted for support.
Figure 4:
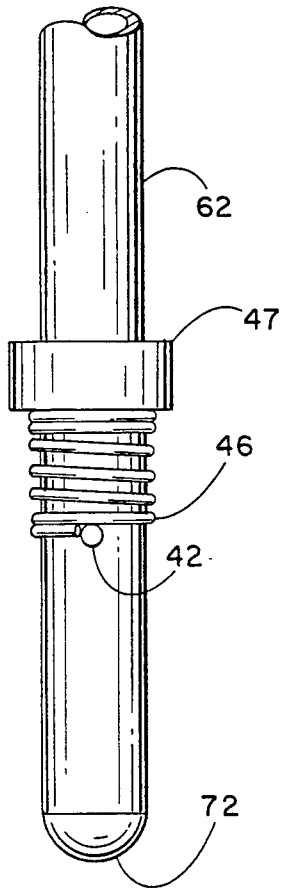
FIG. 4 is a side elevational view of the walking cane portion of my half-step stability cane, showing the connector mechanism thereof which allows the same to be releasably locked to the lower block member.

As shown best in FIG. 2 and FIG. 4, walking cane 16 includes a pressure sensitive lower connector mechanism 40 which is comprised of locking pegs 42 and 44, and compressible spring 46. As shown in FIG. 2, the lower end of walking cane 16 may be inserted through the centrally disposed opening 34 in the lower block member 14 and into socket 52 of socket member 48, which is secured within the interior of lower block member 14, adjacent the upper portion thereof, via bolts 50 or other suitable connecting means. Socket member 48 is constructed so as to extend downwardly a distance which approximates the length of the lower portion of cane 16 which extends below the upper surface 18 of block 14, so as to be coextensive therewith. By surrounding the lower portion of cane 16 in such manner, socket member 48 provides a rigid support for cane 16, and enhances the stability of the structure as a whole.

By aligning locking pegs 42 and 44 with slots 36 and 38 of central opening 34, the lower end portion of walking cane 16 may be pushed downwardly through opening 34 and into socket 52 of socket member 48. Upon doing so, compression spring 46 will be compressed between stop 47 and the upper surface of block member 14, and locking pegs 42 and 44 will extend beneath upper surface 18 into recess 54, which is formed in socket member 48. By thereafter rotating cane member 16 about its longitudinal axis, preferably about 90° from its initial entry position, and releasing the downward pressure upon walking cane 16, the force of compression spring 46 will cause locking pegs 42 and 44 to bear against the inside surface of upper surface 18, thereby locking walking cane 16 to the lower block member 14. Although an approximate 90° rotation is preferred, walking cane 16 will lock to block 14 so long as locking pegs 42 and 44 are rotated to a position which is out of alignment with the keyed slots 36 and 38. In the orientation shown in FIG. 2, a broad-based stability cane is effectively formed which can be used to aid a handicapped individual in walking.

Alternatively, socket member 48 has a second socket 56 and recess 58 which are disposed directly below keyed opening 32, which is adjacent side portion 24 of lower block member 14, and opposite central opening 34 therein. In the same manner as previously discussed for inserting cane 16 within the central connector mechanism or keyed opening 34, walking cane 16 may also be lockably connected in readily releasable keyed relation within connector mechanism or opening 32 (as shown in FIG. 1). As stated previously, in this orientation, the device 10 may be used as a half-step for aiding a handicapped individual in climbing a stairway 12.

Figure 3:
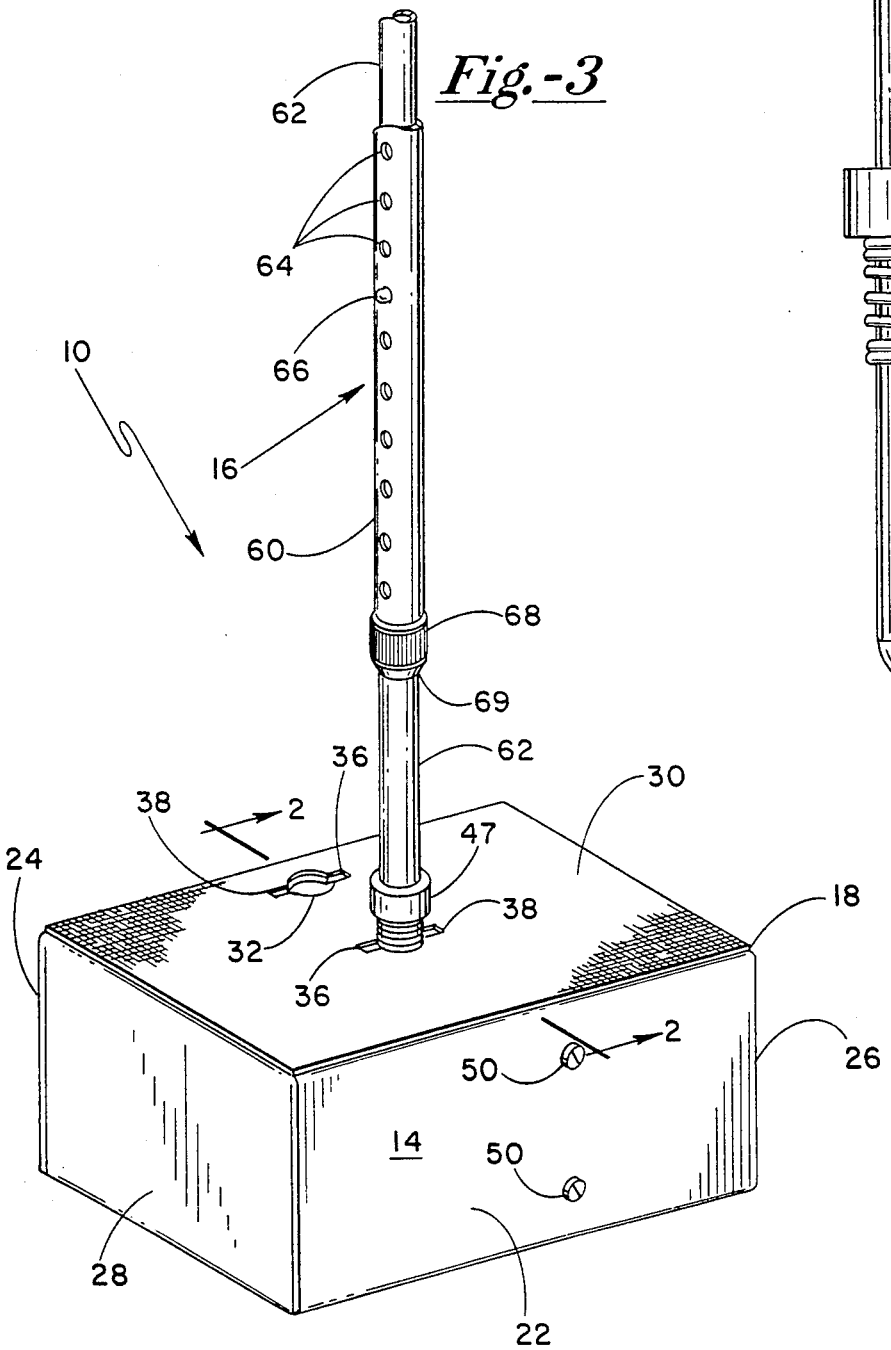
FIG. 3 is a perspective view of my half-step stability cane, showing the cane attached to the lower block member at the central portion thereof, thereby forming a broad-based stability cane.

As shown best in FIG. 1 and FIG. 3, walking cane 16 is vertically adjustable. Walking cane 16 includes an upper elongated tubular section 60 which telescopically receives therein a lower cane section 62. In a conventional manner, the upper cane section 60 includes a plurality of longitudinally spaced holes 64 into which a spring-loaded pin 66, which is carried by lower cane section 62, may extend. Pin 66 is spring-biased outwardly so as to extend outward through one of said openings 64, thereby locking the upper cane section 60 and lower cane section 62 in any one of a plurality of positions. To vertically adjust cane member 16, the handicapped individual may simply depress pin 66 within the confines of upper cane section 60, and slide upper cane section 60 to a new position, where pin 66 will mate with another opening 64.

For added stability, the lower end of upper cane section 60 is threaded (not shown) so as to receive locking nut 68 thereon. Locking nut 68 is beveled inwardly at its lower end 69 such that threading locking nut 68 onto upper cane section 60 will bind upper cane section 60 tightly in secure relation against lower cane section 62.

As shown in FIG. 1, the upper terminal portion of walking cane 16 is curved so as to extend horizontally, and carries a grip 70 to aid the user thereof in manipulating the device as desired. The lower terminal end of walking cane 16 includes a rubber tip 72 which prevents slipping of the walking cane upon use thereof without lower block member 14. Walking cane 16 is readily releasable from lower block member 14 by pushing cane 16 downwardly and rotating the same about its vertical axis, in either direction, so as to align locking pegs 42 and 44 with the keyed slots 36 and 38 of the opening 32 or 34 within which the cane is connected. Releasing the downward pressure upon cane 16 will release locking pegs 42 and 44, thereby allowing walking cane 16 to be removed from lower block member 14.

When using my device 10 as a half-step, the user thereof orientates the device with block 14 resting on the same step upon which he or she is standing (as shown in FIG. 1). While grasping the stairway handrail in one hand, and grip 70 of cane 16 in the other hand, the user steps onto the upper surface 18 of block 14 with one foot. The user then moves the opposite foot to the tread of the next adjacent step. This process is repeated until the user thereof reaches the top or bottom of the stairway, at which time the device 10 can be converted to a stability cane or normal walking cane.

As can be seen from the above disclosure, my new half-step stability cane is useful in aiding a handicapped individual in a number of situations. My device can be used as a half-step for aiding such an individual in climbing stairs. Alternatively, if needed, my device can be converted into a broad-based stability cane. Finally, if such individual is not incapacitated to a point where use of lower block member 14 is necessary, a handicapped individual may readily release the cane 16 from the lower block member 14 and use the same as a standard walking cane. By combining all of the above features within a compact unit, as I have done, a substantial monetary savings may also be realized by avoiding the need for purchasing such items separately.

It will, of course, be understood that various changes may be made in the form, details, arrangement and proportions of the parts without departing from the scope of the invention which comprises of the matter shown and described herein and set forth in the appended claims.

I claim:

1. A device for assisting a handicapped person in traveling up and down a flight of stairs having vertically spaced steps comprising:

(a) an elongated generally rectangular platform having predetermined vertical dimensions suitably chosen such that said platform, when resting on one step of the flight of stairs, provides means for assisting the handicapped person in stepping to the next adjacent step;

(b) said platform having forward and rearward ends, opposite sides, an upper generally flat surface with a central area, and a lower surface having four corner portions extending in the same horizontal plane;

(c) said platform having a connector mechanism disposed at said upper surface adjacent one of said sides intermediate said forward and rearward ends;

(d) an elongated walking cane member having upper and lower ends and a cooperative connector mechanism at said lower end for cooperatively and rigidly engaging said platform connector mechanism in a locking relationship adjacent said one side of said platform and outwardly of said central area while extending normal thereto, to thereby provide a device for assisting the handicapped person in traveling up and down the flight of stairs having vertically spaced steps; and (e) said walking cane member including spring biased release mechanism for releasing said cooperative connector mechanism from said platform connector mechanism through applied pressure at a point adjacent said upper end of said walking cane member.

2. The structure defined in claim 1, wherein said connector mechanism of said walking cane is keyed with said platform connector mechanism adjacent one of said sides of said platform to provide rotatable locking engagement therebetween.

3. The structure defined in claim 1, wherein said platform connector mechanism at said upper surface adjacent one of said sides is located approximately midway between said forward and rearward ends.

4. A device for assisting a handicapped person in traveling up and down a flight of stairs having vertically spaced steps comprising:

(a) an elongated generally rectangular platform having predetermined vertical dimensions suitably chosen such that said platform, when resting on one step of the flight of stairs, provides means for assisting the handicapped person in stepping to the next adjacent step;

(b) said platform having forward and rearward ends, opposite sides, an upper generally flat surface with a central area, and a lower surface having four corner portions extending in the same horizontal plane;

(c) said platform having a first connector mechanism disposed at said upper surface adjacent one of said sides intermediate said forward and rearward ends;

(d) an elongated walking cane member having upper and lower ends and a cooperative connector mechanism at said lower end for cooperatively and rigidly engaging said platform connector mechanism in a readily releasable locking relationship adjacent said one side of said platform and outwardly of said central area while extending normal thereto, to thereby provide a device for assisting the handicapped person in traveling up and down the flight of stairs having vertically spaced steps; and (e) said platform having a second platform connector mechanism located near said central area of said upper surface of said platform for cooperative optional engagement with said connector mechanism of said walking cane to provide a broad-based stability cane for the handicapped person.

5. The structure defined in claim 4, wherein said connector mechanism of said walking cane cooperatively and rigidly engages said second platform connector mechanism in a readily releasable pivotally keyed locking relationship.

6. The structure defined in claim 4, wherein said connector mechanism of said walking cane includes a compressive spring which engages said upper surface of said platform to maintain said walking cane in releasable locking relationship with either of said platform connector mechanisms.

7. The structure defined in claim 4, wherein each of said platform connector mechanisms includes a rigid socket disposed beneath said upper surface of said platform for receiving said lower end portion of said walking cane in close-fitting supporting relation when said cane is connected in locking relation therewith.

8. The structure defined in claim 1, wherein said connector mechanism of said walking cane includes a spring means for causing a tight, secure locking relation with said platform connector mechanism with which said connector mechanism of said walking cane engages.

9. The structure defined in claim 1, wherein said walking cane member is vertically adjustable.

10. The structure defined in claim 1, wherein said connector mechanism of said walking cane and said platform connector mechanism include means to facilitate locking therebetween, whereby pushing said walking cane connector mechanism into said platform connector mechanism and rotating said cane about the longitudinal axis of said cane causes said locking therebetween.

11. The structure defined in claim 1, wherein said platform connector mechanism includes a rigid socket disposed beneath said upper surface of said platform for receiving said lower end portion of said walking cane in close-fitting supporting relation when said cane is connected to said platform.

12. The structure defined in claim 11, wherein said socket extends downwardly below said upper surface of said platform a distance corresponding approximately to the length of said lower end portion of said cane member which extends below said upper surface of said platform when said cane member is engaged in locking relationship therewith.

13. A combined stability cane and device for assisting a handicapped person in traveling up and down a flight of stairs having vertically spaced steps comprising:

(a) an elongated generally rectangular block member having parallel, generally flat upper and lower surfaces and having vertical dimensions of approximately four inches;

(b) said block member having forward and rearward ends, opposite sides, and a central area at said upper surface;

(c) first connector mechanism carried by said block member at said upper surface at said central area;

(d) second connector mechanism carried by said block member at said upper surface adjacent one of said sides;

(e) a walking cane member having upper and lower ends; and (f) said cane member having cooperative connector mechanism at said lower end for cooperatively and rigidly engaging said first connector mechanism of said block member at said central area while extending normal to said flat upper surface to thereby provide a stability cane for such a handicapped person, and for alternatively cooperatively and rigidly engaging said second connector mechanism of said block member while extending normal to said flat upper surface to thereby provide a device for assisting such a handicapped person in traveling up and down the flight of stairs having vertically spaced steps.

14. The structure defined in claim 13, wherein said second connector mechanism at said upper surface adjacent one of said sides is located intermediate said forward and rearward ends.

15. The structure defined in claim 13, wherein said second connector mechanism at said upper surface adjacent one of said sides is located approximately midway between said forward and rearward ends.

16. The structure defined in claim 13, wherein said second connector mechanism adjacent one of said sides is located opposite said first connector mechanism at said central area of said upper surface of said block member.

17. The structure defined in claim 13, wherein said first connector mechanism at said central area of said block member includes a rigid socket disposed beneath said upper surface of said block member for receiving said lower end of said walking cane in close-fitting supporting relation when said cane is connected to said block member at said central area.

18. The structure defined in claim 13, and a rigid socket member disposed beneath said upper surface of said block member and beneath said second connector mechanism adjacent one of said sides of said block member, said socket member receiving said lower end of said cane member in tight-fitting rigid relation when said cane member is connected to said block member by said second connector mechanism at one of said sides of said block member.

19. The structure defined in claim 13, wherein said connector mechanism of said walking cane member is constructed to rigidly engage either said first or second connector mechanism carried by said block member in a readily releasable locking relationship therewith.

20. The structure defined in claim 13, wherein said cooperative connector mechanism of said walking cane member includes a compressive spring which bears against said upper surface of said block member when said cane member is lockably connected thereto so as to firmly secure said cane member in releasable, but locked relationship therewith.

21. In a device for use by a handicapped person in walking and in traveling up and down a flight of stairs, in combination, comprising:

(a) a flight of stairs having vertically spaced steps, each step having a tread and a vertically extending riser;

(b) an elongated generally rectangular block member having a generally flat upper surface and four lower corner portions each extending in the same horizontal plane parallel to said flat upper surface, said block being constructed with dimensions which facilitate placement of said lower four corners of the same upon said tread of one of said steps;

(c) said block member having forward and rearward ends, opposite sides, and a central area at said upper surface;

(d) said block member having vertical dimensions approximately one half the vertical dimensions of one of said risers of said steps;

(e) first connector mechanism carried by said block member at said upper surface at said central area;

(f) second connector mechanism carried by said block member at said upper surface adjacent one of said sides;

(g) a walking cane member with upper and lower ends; and (h) said cane member having cooperative connector mechanism at said lower end for cooperatively and rigidly engaging said first connector mechanism of said block member at said central area while extending normal to said flat upper surface to thereby provide a stability cane for such a handicapped person while walking, and for alternatively cooperatively and rigidly engaging said second connector mechanism of said block member while extending normal to said flat upper surface to thereby provide a device for assisting such a handicapped person in traveling up and down said flight of stairs.

22. The structure defined in claim 21, wherein said cane member includes a rubber pad at said lower end for use of said cane without said block member.

23. The structure defined in claim 21, wherein each of said first and second connector mechanisms carried by said block member includes a rigid socket disposed beneath said upper surface for receiving said lower end portion of said walking cane in close-fitting relation when said cane is connected thereto.

24. The structure defined in claim 21, wherein said cooperative connector mechanism of said cane member engages one of said first or second connector mechanisms carried by said block member in readily releasable pivotally keyed locking relation therewith.

* * * * *

UNITED STATES PATENT AND TRADEMARK OFFICE

CERTIFICATE OF CORRECTION

PATENT NO. : 5,318,057

DATED : June 7, 1994

INVENTOR(S) : Ronald I. Wallum

It is certified that error appears in the above-identified patent and that said Letters Patent is hereby corrected as shown below:

Column 1, lines 29 - 62, beginning with the word "stairs.....and" should be deleted.

Column 2, line 26, after the word "of" insert the following:

stairs having vertically spaced steps, without the assistance of others. The device includes a platform or block member having flat parallel upper and lower surfaces and vertical dimensions of approximately four (4) inches, which is about half the vertical dimensions of the risers of most steps in a flight of stairs. A pair of connector mechanisms, comprising keyed openings in the upper surface of the block member, are provided. One such connector mechanism is disposed at the central area of the upper surface of the block member, and the other adjacent one side of the block member.

UNITED STATES PATENT AND TRADEMARK OFFICE

CERTIFICATE OF CORRECTION

PATENT NO. : 5,318,057

DATED : June 7, 1994

INVENTOR(S) : Ronald I. Wallum

It is certified that error appears in the above-identified patent and that said Letters Patent is hereby corrected as shown below:

A walking cane having a cooperative connector mechanism adjacent its lower end is also provided. When the cane is connected to the block member adjacent its side, the device enables a handicapped person to travel up and down the steps, without any assistance, by using the platform as a half-step and carrying it with him from step to step, moving up or down, as the case may be, as each step is completed. The device provides high stability and minimizes the vertical distance the handicapped person must move his body in each movement.

UNITED STATES PATENT AND TRADEMARK OFFICE

CERTIFICATE OF CORRECTION

PATENT NO. : 5,318,057

DATED : June 7, 1994

INVENTOR(S) : Ronald I. Wallum

It is certified that error appears in the above-identified patent and that said Letters Patent is hereby corrected as shown below:

When the walking cane is connected to the central area of the block member, the handicapped person enjoys a highly stable stability cane in that the broad-based under-surface of the block member bears evenly upon the supporting surface therefor. The rectangular under-surface of the block member is continuous, rather than having bearing surfaces at three (3) or four (4) isolated locations, and thus it is much more stable.

Rigidly mounted within the block member immediately below its upper surface is a plastic socket member having a pair of rigid sockets therein for stabilizing the connection between the block member and Signed and Sealed this Twenty-fifth Day of October, 1994

*Attest:*

Bruce Lehman

BRUCE LEHMAN

*Attesting Officer*

*Commissioner of Patents and Trademarks*